US005369725A

United States Patent [19]

Iizuka et al.

[11] Patent Number: 5,369,725

[45] Date of Patent: Nov. 29, 1994

[54] PITCH CONTROL SYSTEM

[75] Inventors: Tatsushi Iizuka; Satoshi Shinohara, both of Tokyo, Japan

[73] Assignee: Pioneer Electronic Corporation, Tokyo, Japan

[21] Appl. No.: 919,019

[22] Filed: Jul. 23, 1992

[30] Foreign Application Priority Data

Nov. 18, 1991 [JP] Japan ..... 3-302153

[51] Int. Cl.[5] ..... G10L 3/02

[52] U.S. Cl. ..... 395/2.16; 395/2.74

[58] Field of Search ..... 395/2, 2.16, 2.2, 2.74; 381/29-50

[56] References Cited

U.S. PATENT DOCUMENTS

| | | | |
|---|---|---|---|
| 4,121,058 | 10/1978 | Jusko et al. | 395/2 |
| 4,586,191 | 4/1986 | Nishimura | 395/2 |
| 4,700,391 | 10/1987 | Leslie, Jr. et al. | 381/35 |
| 4,907,277 | 3/1970 | Callens et al. | 381/46 |
| 5,131,042 | 7/1992 | Oda | 381/34 |

*Primary Examiner*—David D. Knepper
*Attorney, Agent, or Firm*—Perman & Green

[57] ABSTRACT

A system for controlling the pitch between an original sound and a reproduced sound system in which generation of tremolo sound is suppressed and a clock is used commonly for write timing and read timing of a ring buffer. Digital data are obtained by sampling an analog input signal and data are interpolated before writing to a memory of the ring buffer, and a plurality of write positions are provided and the data is written while controlling addresses. Address spacings between a plurality of read memory positions are different from each other. Coefficients are set within a range from a predetermined negative value to a predetermined positive values according to address spacing to write memory position for each of the read memory positions, and the data read from each of a plurality of read memory positions are multiplied by the corresponding coefficient. The resultant data values are summed up and are used as output data. Further, a comb line filter is provided in a signal path.

4 Claims, 6 Drawing Sheets

PITCH CONTROL SYSTEM

BACKGROUND OF THE INVENTION

1. Field of the Invention

The present invention relates to a pitch control system, and in particular to a pitch control system for controlling a pitch between an original sound and a reproduced sound by changing the frequency of an audio signal to a desired frequency.

2. Background Information

As a pitch control system of conventional type, a system is known, in which digitized data obtained through sampling of an analog input signal is sequentially written in a ring buffer, and the data are read out at a period different from the writing period. By sequentially demodulating the data read in this way, the interval of the signal is changed. When the pitch is to be lowered in such system, the reading period of the data from the ring buffer is made longer than the writing period. To raise the pitch (key), the reading period of the data from the ring buffer is made shorter than the writing period. Accordingly, a reading address for reading the data is relatively revolved with respect to a writing address for writing the data to the ring buffer, and the former address outruns the latter address or the former address is outrun by the latter address at a predetermined period. At the writing position to write the data of the ring buffer, the previously written data are sequentially rewritten, and the contents of the data are discontinuous in such a condition. When the reading position is at the rewritten position, discontinuous point will appear in the reproduced sound. To alleviate this effect, a so-called cross-fade method is used. Herein after an explanation will be made on a case where the reading period is shorter than the writing period. As shown in FIG. 1(A), the value $d_{R-W}$ showing the difference between the writing position W and the reading position R of the ring buffer is normally higher than the predetermined value $d_{th}$. It is supposed that each position on the ring buffer advances clockwise, and a reading position R advances clockwise faster than it. When $d_{R-W} < d_{th}$, the data is also read from another reading position R', which is separated from the reading position R by the predetermined value $d_{th}$ in clockwise direction as shown in FIG. 1(B). The data from the reading position R is linearly processed by fade-out processing, and the data value from the reading position R' is linearly processed by fade-in processing. By summing these values, cross-fade processing is performed. From this time on, the data are outputted from the reading position, which does not pass a discontinuous point. Usually, the value $d_{th}$ is set to ½ of the size of the ring buffer.

However, because the number of the reading position changes from 1 to 2 during the cross-fade period, an effect like that of a comb filter occurs, and some of the frequency components in the signal have phases opposite with each other. In this case, the frequency components are canceled with each other. If in the same phase, the level of such frequency components is increased and a so-called comb type characteristics (shown as characteristic B in FIG. 2) appears. Since a flat characteristics (shown as characteristic A in FIG. 2) is obtained during the period in which cross-fade is not performed the fluctuation of frequency characteristic increases at the positions indicated by arrows in FIG. 2 (frequencies $f_{1,3,5,\ldots}$) in response to the cross-fade period, generating so-called tremolo. In the writing and reading methods as described above, it is necessary to separately generate writing timing clock and reading timing clock.

SUMMARY OF THE INVENTION

It is an object of the present invention to provide a pitch control system for suppressing the generation of tremolo sounds. Another object of the invention is to provide a pitch control system, which has a common clock for determining writing timing and reading timing.

The interval control system according to a first aspect of the present invention comprises interpolating means for decreasing from a plurality of consecutive inputted data of digitized audio signal obtained through sampling at predetermined sampling intervals a predetermined number of data when a pitch is to be raised, and for increasing a predetermined number of data when the pitch is to be lowered, a ring buffer with a predetermined memory size, writing and reading means for simultaneously writing one or more continuous interpolated data at a write memory position of a specified write address on the ring buffer at intervals of the period of sampling and for reading from a read memory position of at least one specified read address of the ring buffer at intervals of the sampling period, and address specifying means for specifying write address and read address at each of the above intervals, whereby the address is corrected to exclude empty space for the written data if the data are decreased when the pitch is to be raised, and the address is corrected so that the written data are not in excess if the data are increased when the pitch is to be lowered.

The interval control system according to a second aspect of the present invention comprises writing and reading means for writing inputted data of digitized audio signal at predetermined sampling intervals to a write memory position of a specified write address of a ring buffer having a predetermined memory size and for reading the data stored in the ring buffer from a plurality of memory positions of the ring buffer at intervals different from intervals corresponding to the sampling interval in the order of the data, coefficient setting means for setting coefficients according to address spacing with a write memory position of he ring buffer for each of a plurality of read memory positions of the ring buffer, and computing means for multiplying the read data for each of a plurality of read memory positions by the corresponding coefficients and for summing up the resultant data and using this as an output data, whereby the address spacing between a plurality of read memory positions is different from each other.

The pitch control system according to a third aspect of the invention comprises writing and reading means for writing inputted data of digitized audio signal with predetermined sampling intervals to a write memory position of a specified write address of a ring buffer with a predetermined memory size and for reading the data stored in the ring buffer from a plurality of memory positions of the ring buffer at intervals different from the intervals corresponding to the sampling interval, coefficient setting means for setting coefficients corresponding to the address spacing with the write memory position of the ring buffer at each of a plurality of read memory positions of the ring buffer, and computing means for multiplying the read data for each of a plurality of memory read positions with the corresponding coefficients and for summing up the resultant data and using this as an output data, whereby the coefficient setting means sets each of the coefficients to a value, which varies within a range from a predetermined negative value to a predetermined positive value.

The interval control system according to a fourth aspect of the invention comprises writing and reading means for writing inputted data of digitized audio signal with predetermined sampling intervals to a write memory position of a specified write address of a ring buffer with a predetermined memory size in the order of the data and for reading the data stored in the ring buffer from a plurality of memory positions of the ring buffer at intervals different from the intervals corresponding to the sampling intervals, coefficient setting means for setting coefficients according to address spacing with a write memory position of the ring buffer at each of a plurality of read memory positions of the ring buffer, and computing means for multiplying the read data with the corresponding coefficient at each of a plurality of memory read positions and for summing up the resultant data and using his as an output data, whereby a comb line filter based on delay time equal to time difference for reading one data at a plurality of read memory positions is furnished in a signal passage.

In the interval control system according to the first aspect of the invention, a predetermined number of continuous original sample data of the inputted digitized audio signal are written on the ring buffer at the time of original sampling after being synthesized to a necessary number of data through interpolation in accordance with raising or lowering amount of the interval. In case the data is increased, the advanced address is written, and when the data are decreased, the decreased address is written so that the data are in proper quantities. The data are read at a predetermined read memory position at the timing of original sampling.

In the pitch control system according to the second aspect of the present invention, the time difference between two or more read data is made different by making the address spacings between two or more read memory positions different from each other.

In the pitch control system according to the third aspect of the invention, frequencies to generate tremolo are changed for each cross-fade by making the coefficient to a value, which changes within a range from a predetermined negative value to a predetermined positive value.

In the pitch control system according to the fourth aspect of the invention, tremolo sound component band is eliminated by a comb line filter.

DETAILED DESCRIPTION OF THE PREFERRED EMBODIMENTS

In the following, detailed description will be given on the embodiments of the present invention in connection with the drawings.

Figure 1:
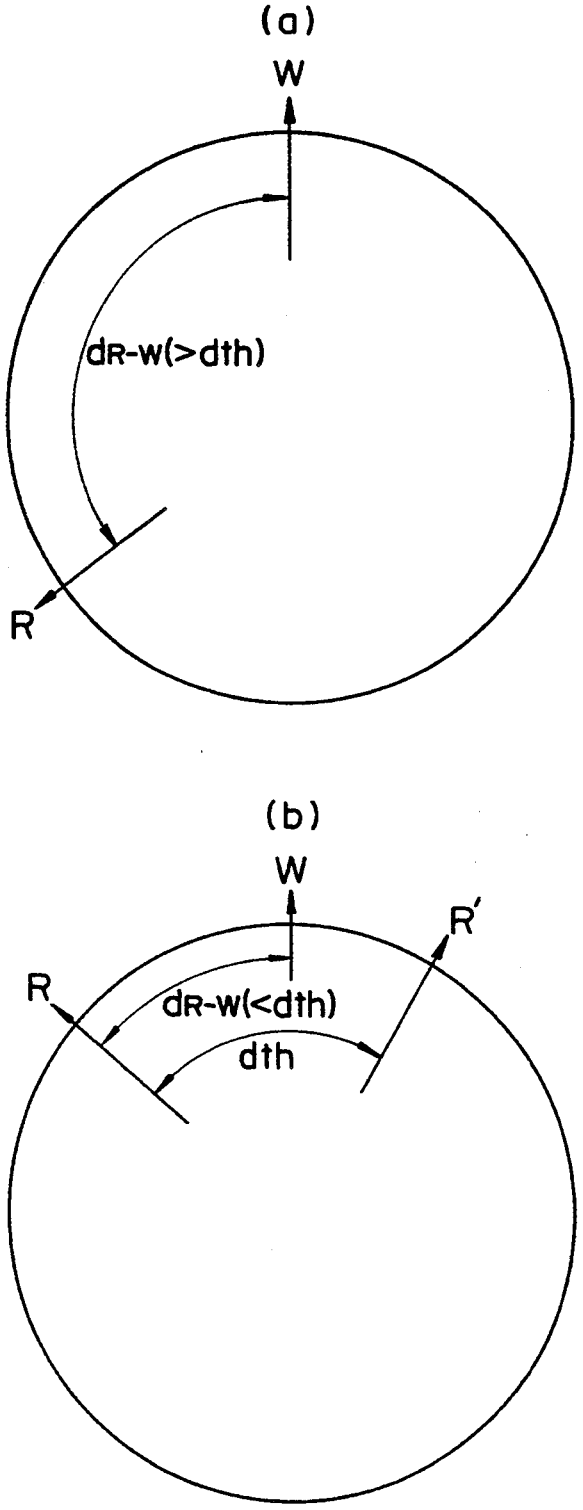
FIGS. 1(*a*) and (*b*) shows positional relationship between write address and read address of a ring buffer in a conventional type interval control system.
Figure 2:
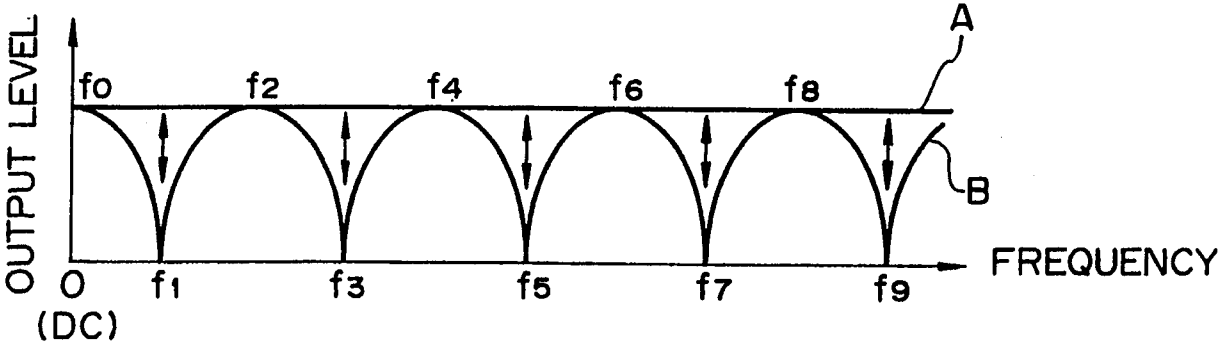
FIG. 2 represents frequency characteristics at cross-fade processing of a conventional type interval control system.
Figure 3:
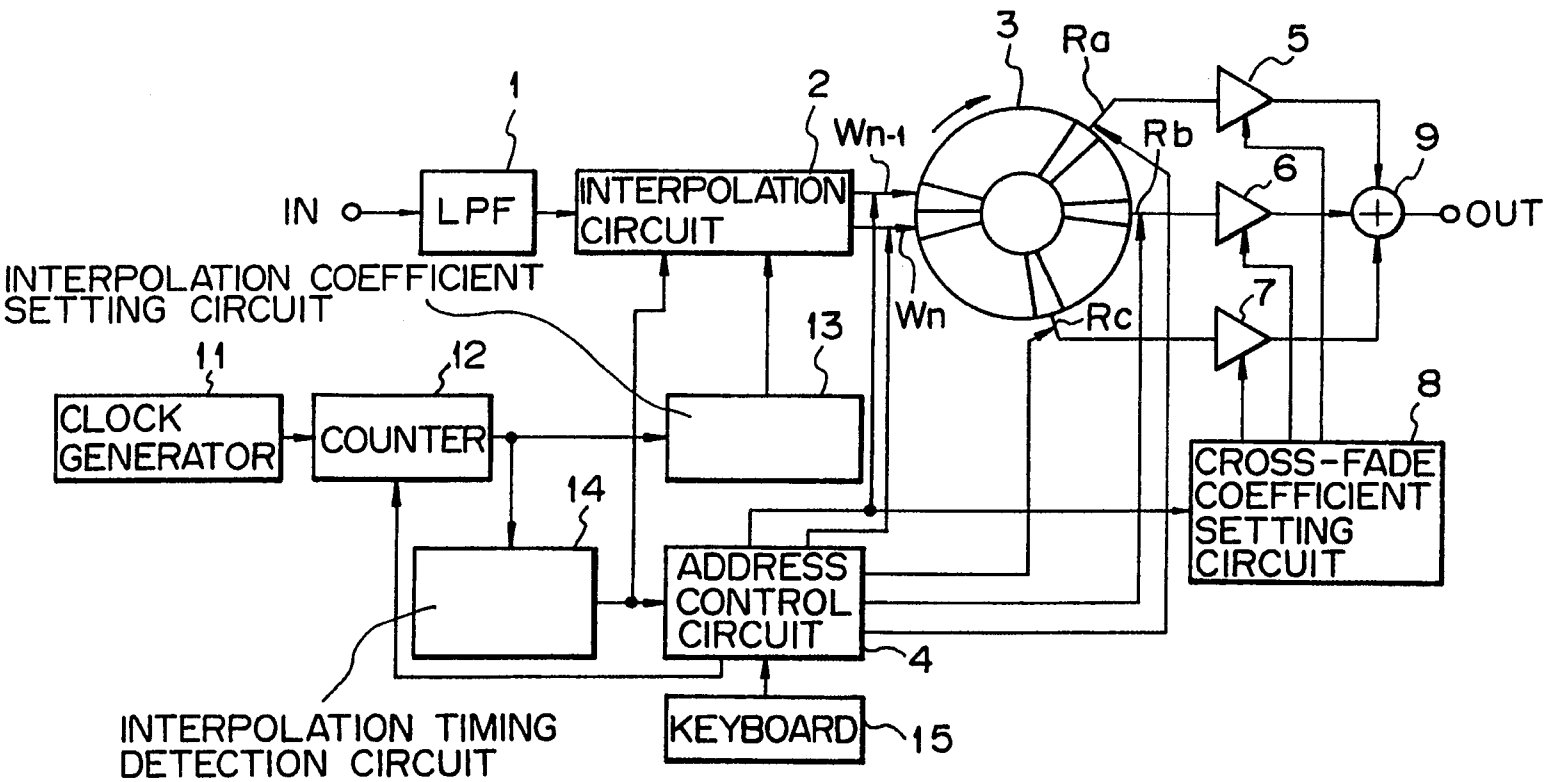
FIG. 3 is a block diagram of an embodiment according to a first aspect of a third aspect of the present invention.

In the interval control system of the present invention shown in FIG. 3, an LPF (low pass filter) 1 is connected to an input terminal IN where digital audio signal is supplied. LPF 1 is furnished to prevent a liaising, and it is a secondary IIR type filter. An interpolation circuit 2 prepares "k+1" or "k−1" data from "k" data (k is a positive integer and a constant.) according to sampling timing of the supplied digital audio signal. The interpolation circuit 2 has two continuous data outputs, and the two outputs are connected to a ring buffer 3. From the ring buffer 3, three readings are made from different addresses within a period, during which the ring buffer makes a full turn. The read address of the ring buffer 3 is controlled by an address control circuit 4. To the three reading outputs, multipliers 5, 6 and 7 are connected. The multipliers 5, 6, and 7 multiply the read signal by coefficients. The coefficients $K_a$, $k_b$ and $k_c$ of the multipliers 5, 6 and 7 are set by a cross-fade coefficient setting circuit 8. To the cross-fade coefficient setting circuit 8, output of the address control circuit 4 consisting of a microcomputer is connected. An adder 9 is connected to output of each of the multipliers 5, 6 and 7 so that the output signals of the multipliers 5, 6 and 7 are summed up. The output of the adder 9 is connected to an output terminal OUT.

A counter 12 is connected to output of a clock generator 11. The clock generator 11 generates clock pulse synchronized with sampling timing of the original input digital audio signal, and the counter 12 repeatedly counts clock pulses outputted from the clock generator 11 from 0 to k−1 or k+1. An interpolation coefficient setting circuit 13 and an interpolation timing detection circuit 14 are connected to output of the counter 12. The interpolation coefficient setting circuit 13 sets an interpolation coefficient g according to the value counted by the counter 12, and the interpolation coefficient g is supplied to the interpolation circuit 2. The interpolation timing detection circuit 14 generates an interpolation timing signal according to the value counted by the counter 12. The interpolation timing signal is supplied to the interpolation circuit 2 and the address control circuit 4. The address control circuit 4 specifies two continuous write addresses, in which two output data of the interpolation circuit 2 are to be written. A keyboard 15 is connected to the address control circuit 4, and the keyboard 15 can input key-up amount during key-up (raising the pitch) or key-down amount during key-down (lowering the pitch). Further, the address control circuit 4 is connected to the counter 12 and specifies count value.

LPF 1, interpolation circuit 2, address control circuit 4, multipliers 5, 6 and 7, adder 9, cross-fade coefficient setting circuit 8, counter 12, interpolation coefficient setting circuit 13 and interpolation timing detection circuit 14 can be constituted by a DSP. Memory size (the number of memories for a full turn) of the ring buffer and the constant k can be set to predetermined values according to key-up or key-down amount of the interval.

In the above arrangement, the interpolation circuit 2 interpolates the data with "k" sample data as a unit. Specifically, sample data in quantities from "k" to "k−1" are prepared during the key-up, and the sample data in the quantities from "k" to "k+1" are prepared during the key-down. Concrete description will be given below on the interpolation operation. If it is supposed that the sample data during the key-up is $x_p$, sample data $x_p$ is: $x_0, x_1, \ldots, x_{k-1}$ and in quantity "k" in total. If it is supposed that the interpolation data obtained as the result of interpolation is $x_p'$, the interpolation data $x_p'$ are: $x_1', \ldots, x_{x-1}$ and in quantity "k−1" in total, and there is no $x_0'$. The calculation equation of the interpolation data is as follows:

$$x_p' = g \cdot x_p + (1-g) \cdot x_{p-1} \quad (1)$$

In this case, the coefficient g is given by:

$$g = (p-1)/(k-1) \quad (2)$$

and this is sequentially outputted from the interpolation coefficient setting circuit 13. For example, if k=4 and in case interpolation data $x_1'$, $x_2'$ and $x_3'$ are prepared from 4 continuous sample data $x_0$, $x_1$, $x_2$ and $x_3$, the interpolation data are as given in the following table:

TABLE 1

| p | 0 | 1 | 2 | 3 |
|---|---|---|---|---|
| g | — | 0 | $\frac{1}{3}$ | $\frac{2}{3}$ |
| $x_p'$ | — | $x_0$ | $\frac{1}{3}x_2 + \frac{2}{3}x_1$ | $\frac{2}{3}x_3 + \frac{1}{3}x_2$ |

During the key-down, interpolation is performed from the sample data $x_p$ in quantity "k", i.e. $x_0, x_1, \ldots, x_{x-1}$, and t here are "k+1" interpolation data $x_p'$, i.e. $x_0', x_1', \ldots, x_k'$. The calculation equation of interpolation data is the same as the above equation (1). In this case, the coefficient g is given by:

$$g = 1 - p/(k+1) \quad (3)$$

and it is sequentially outputted from the interpolation coefficient setting circuit 13. For example, if k=4, and in case interpolation data $x_0'$, $x_x'$, $x_2'$, $x_3'$ and $x_4'$ are prepared from 4 continuous sample data $x_0'$, $x_1'$, $x_2$ and $x_3$, the interpolation data are as given in the following table.

TABLE 2

| p | 0 | 1 | 2 | 3 | 4 |
|---|---|---|---|---|---|
| g | 1 | $\frac{4}{5}$ | $\frac{3}{5}$ | $\frac{2}{5}$ | $\frac{1}{5}$ |
| $x_p'$ | $x_0$ | $\frac{4}{5}x_1 + \frac{1}{5}x_0$ | $\frac{3}{5}x_2 + \frac{2}{5}x_1$ | $\frac{2}{5}x_3 + \frac{3}{5}x_2$ | $\frac{1}{5}x_4 + \frac{4}{5}x_3$ |

However, the time when P=4 is the time when P=0. At this time point, the results of both calculations are present.

Figure 4:
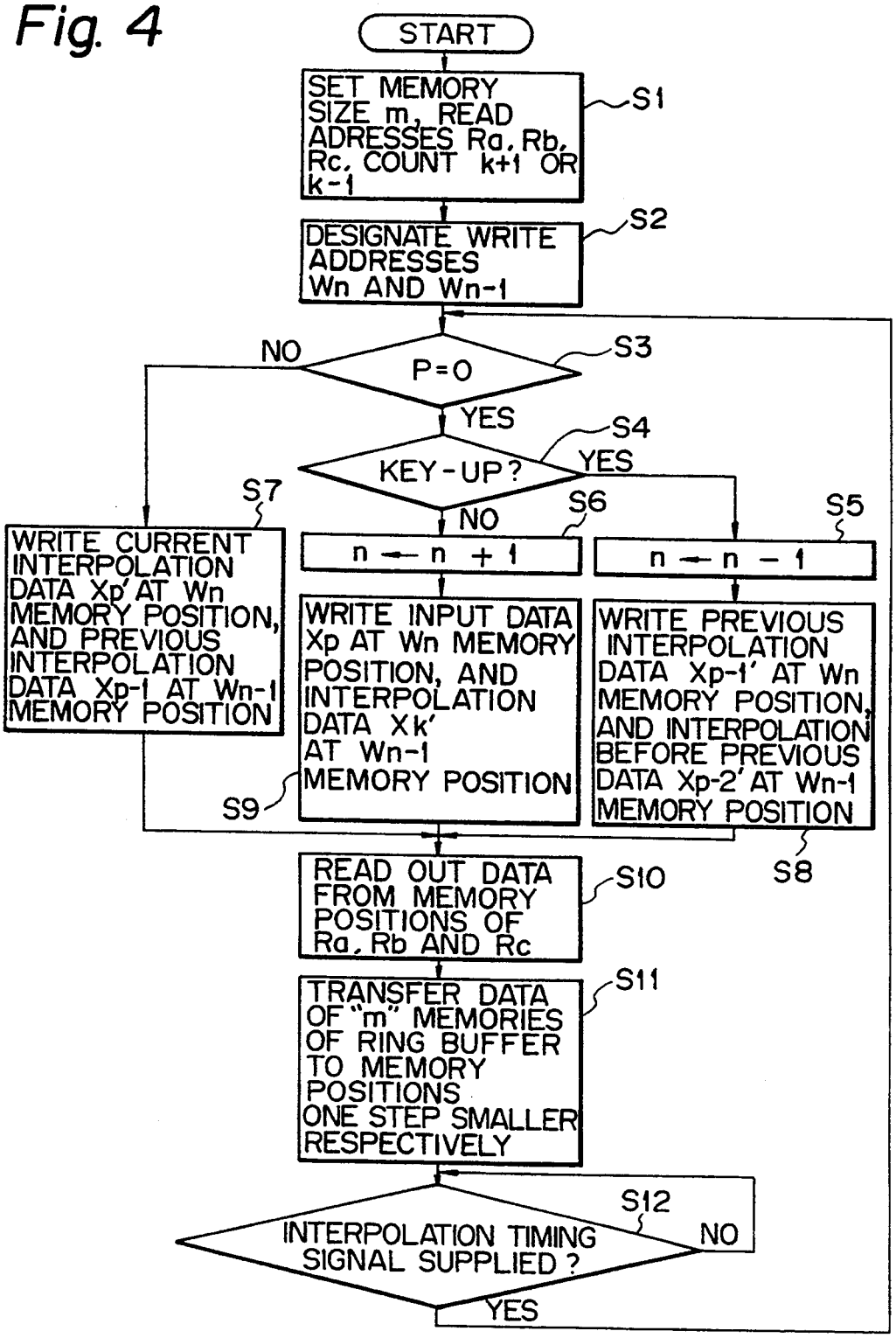
FIG. 4 is a flow chart showing operation of an address control circuit of the system of FIG. 3.

Next, description is given on the operation of the address control circuit 4, referring to the flow chart of FIG. 4. When either key-up amount or key-down amount is specified by the keyboard 15, the address control circuit 4 sets memory size m of the ring buffer 3, read addresses $R_a$, $R_b$ and $R_c$, and count value "k+1" or "k−1" (Step S1). The address is to be 0 to m−1 and increases counterclockwise in FIG. 3. The rotating direction of the data is clockwise as shown by arrow. The rotation of data means that the transfer of data. Because memory size m of the ring buffer 3, read addresses $R_a$, $R_b$ and $R_c$, and count value "k+1" or "k−1" are recorded in advance on ROM (not shown) in the address control circuit 4 in accordance with the key-up amount and the key-down amount, they are read out from ROM according to the key-up amount or the key-down amount as specified.

The difference of adjacent read addresses with the memory size m of the ring buffer 3 and the read addresses $R_a$, $R_b$ and $R_c$ is given by the following equation ($m-1 \geqq R_a > R_b > R_c \geqq 0$):

$$|R_a - R_b| + |R_b - R_c| + |m + (R_c - R_a)| = m \quad (4)$$

where $$|R_a - R_b| \neq |R_b - R_c|,\ |R_b - R_c| \neq |m + (R_c - R_a)|,\ |m + (R_c - R_a)| \neq |R_a - R_b|$$

$R_b$ and $R_c$ are set in such manner that these differences are elementary to each other.

As the result, the frequencies to generate tremolo between two phases become different from each other, and this will reduce tremolo feeling.

The address control circuit 4, synchronized with interpolation timing signal, specifies continuous addresses $W_n$, $W_{n-1}$ of the ring buffer 3 as write addresses (Step S2). When the Step S2 is executed immediately after the key-up amount or the key-down specified, the initial value is set to the addresses $W_n$, $W_{n-1}$ are specified. Next, it is checked whether p of the data $x_p$, i.e. count value of the counter 12 is 0 or not (Step S3). If p=0, it is checked whether it is in key-down operation or in key-up operation (Step S4). If it is in key-up operation, 1 is subtracted from the variable n (Step S5). If it is in key-down operation, 1 is added further to the variable n (Step S6).

If p=0 in Step S3, the current interpolation data $x_p'$ are written at memory position of the address $W_n$ of the ring buffer 3, and the previous interpolation data $x_{p-1}'$ are written to memory position of the address $W_{n-1}$ (Step S7). After Step S5 has been executed, the previous interpolation data $x_{p-1}'$ are written at memory position of the address $W_n'$ and the interpolation data before previous data $x_{p-2}'$ is written at memory position of the address $W_{n-1}$ (Step S8). After Step S6 has been executed, $x_0' = x_0$, i.e. input data to the interpolation circuit 2 are written as $x_p$ at memory position of the address $W_n$, and interpolation data $x_k'$ is written at memory position of the address $W_{n-1}$ (Step S9).

Therefore, the current interpolation data is written at memory position of the address $W_n$ of the ring buffer 3 during the key-up and key-down when p=0, and the previous interpolation data are written at memory position of the address $W_{n-1}$. For example, either one of the above interpolation data $x_1'$, $x_2'$ or $x_3'$ is written at memory position of the address $W_n$, and the same data as the previous data are written again at memory device of the address $W_{n-1}$, i.e. at memory position which was at the address $W_n$ previously. During the key-up when p=0, it is returned to the previous write address by Step S5. The previous two write interpolation data are written again at the same memory position as the previous data, and operation is duplicated. This is because the data are packed to prevent the presence of empty space an there is no interpolation data $x_0'$ when p=0 during the key-up. During the key-down when p=0, write address is advanced by one in Step S6, and new data are written at both addresses $W_n$ and $W_{n-1}$. That is, because interpolation data are increased by one during the key-down, the interpolation data $x_4'$ are written at memory position of the address $W_{n-1}$ only when p=0, and the interpolation data $x_0'$ (=$x_0$) of the next data group are written at memory position of the address $W_n$. Although duplicate writing is performed in the present embodiment, the duplicate writing itself is originally useless, and there is a control method, by which duplicate writing is detected and writing is not done.

The address control circuit 4 reads out the data from memory position of the read addresses $R_a$, $R_b$ and $R_c$ respectively (Step S10). The data thus read are supplied to the multipliers 5, 6 and 7. After Step S10 has been executed, "m" data stored in memory of the ring buffer 3 are transferred to memory position smaller by one step of each address (Step S11). In this case, the data at memory position of the address O are transferred to memory position of the address m−1. Then, it is checked whether the interpolation timing signal has been supplied or not (Step S12). If the interpolation timing signal has been supplied, the procedure returns to Step S3.

If n=−1 when 1 is subtracted from the variable n in Step S5, the variable n is set to m−1. If n=0 when 1 is subtracted from the variable n, n−1 is set to m−1. If n=0 in Step S9, "n−1" in $W_{n-1}$ is re-read as "m−1".

In the above operation of the address control circuit 4, the procedure is executed from Step S1 if the key-up amount or the key-down amount is specified or changed by the keyboard 15.

By interpolating the data before writing, it is possible to commonly perform write timing and read timing, and one clock frequency will suffice.

Figure 5:
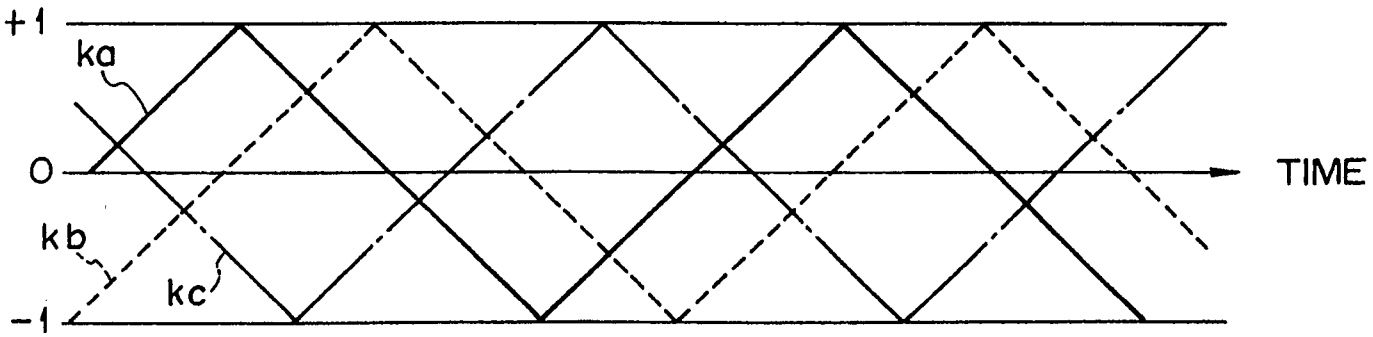
FIG. 5 is a diagram showing changes of each coefficient.

Next, the cross-fade coefficient setting circuit 8 sets coefficient $k_a$, $k_b$ and $k_c$ based on the differences $R_a-W_n$, $R_b-W_n$ and $R_c-W_n$ between the read addresses $R_a$, $R_b$ and $R_c$ and the write address $W_n$. If the difference is 0, $k_a=0$. With the increase of the difference, $k_a$ decreases. When the difference is m, $k_a=0$, and when the difference is 3m/2, $k_a$ reaches the minimum value (maximum negative value) −1. Thereafter, it increases again and returns to the initial value 0 when the difference is 2 m. That is, when the write address passes by the read address, the coefficient is 0, and when these are separated at the widest, the coefficient is +1 or −1. Thus, the change of the coefficient $k_a$ forms a waveform having one cycle with two crossings of the write address and the read address. The same applies to the case of $k_b$ and $k_c$, but the waveforms are deviated from each other because the timing to cross the write address is deviated. One such example is given in FIG. 5, where the relationship between the coefficients $k_a$, $k_b$ and $k_c$ and the time is shown when change characteristics are linear. In the cross-fade coefficient setting circuit 8, the coefficients $k_a$, $k_b$ and $k_c$ may be calculated from the read addresses $R_a$, $R_b$ and $R_c$ and the write address $W_n$, and memory size m by synchronizing with the interpolation timing signal and using a predetermined functional equation. Or, the values of the coefficients determined from the read addresses $R_a$, $R_b$ and $R_c$, the write address $W_n$ and the address size m may be stored in advance in memory such as ROM, and the coefficients $k_a$, $k_b$ and $k_c$ may be determined by reading the corresponding coefficients from the values of $R_a$, $R_b$ and $R_c$, $W_n$ and m. The change characteristics of the coefficients $k_a$, $k_b$ and $k_c$ may be curve instead of linear as shown in FIG. 5.

The coefficients $k_a$, $k_b$ and $k_c$ thus set are supplied to the multipliers 5, 6 and 7 as digital signals. The multiplier 5 multiplies the data read from the read address $R_a$ by the coefficient $k_a$, the multiplier 6 multiplies the data read from the read address $R_b$ by the coefficient $k_b$, and the multiplier 7 multiplies the data read from the read address $R_c$ by the coefficient $k_c$. The output signals for the multipliers 5, 6 and 7 are supplied to the adder 9 and are summed up. From the adder 9, the interval-controlled digital signals are issued.

By changing the coefficients $k_a$, $k_b$ and $k_c$ within a range from −1 to +1, cross-fade in the same phase (in-phase) and cross-fade in opposite phase are generated alternatively between two phases. Solid line comb characteristics are generated in case of the same phase, and broken line comb characteristics in case of opposite phase alternately. The frequency to generate tremolo due to level change shown by arrow is dispersed. The average level on that portion moves up and the feeling of tremolo is reduced. In case of the above embodiment, 3-phase cross-fade is performed, and the frequencies to generate tremolo are dispersed more widely.

In the above embodiment, the interpolation circuit 2 prepares "k+1" or "k−1" data, whereas the data may be prepared in any other quantity by setting the write position at two or more positions. Or, the reading position on the ring buffer may be 2 or 4 positions instead of 3.

Figure 7:
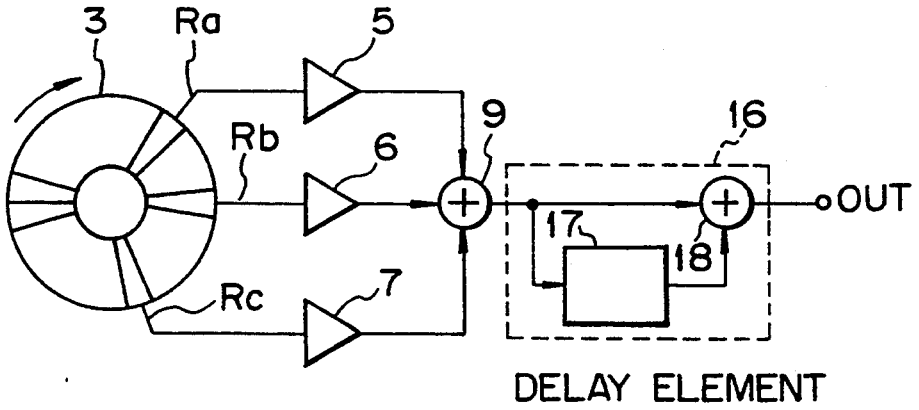
FIG. 7 is a block diagram showing an embodiment according to a fourth aspect of the present invention.

FIG. 7 shows a part of a pitch control system of an embodiment according to a fourth aspect of the present invention. In this system, a comb line filter 16 is furnished on output of an adder 9, and output of the comb line filter 16 is connected to an output terminal OUT. The comb line filter 16 comprises a delay element 17 for delaying output signal of the adder 9, and an adder 18 for adding output signals of the adder 9 and the delay element 17. The other arrangement is the same as in the system of FIG. 3. The comb line filter can be constituted by DSP.

Figure 8:
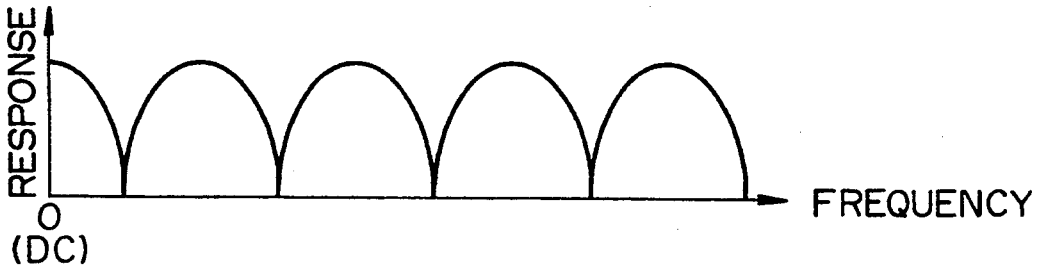
FIG. 8 shows characteristics of a comb line filter in the system of FIG. 7.

In such arrangement, the output signal of the adder 9 is delayed by the delay element 17 of the comb line filter 16, and the delay signal and the output signal of the adder 9 are added by the adder 18. For example, if delay time of the delay element 17 is 0.1 sec., the delay signal is delayed by 0.1 sec. compared with the output signal of the adder 9, i.e. with the original signal. Thus, if the original signal is a DC signal, the signal after adding is doubled. At 10 Hz, crest and crest of signals are overlapped, and so do trough and trough of the signals, and the signal level is doubled. At the frequencies such as 20 Hz, i.e. multiple of 10 Hz, the signal level is also doubled. However, at intermediate frequencies such as 5 Hz, 15 Hz, etc., two signals negate each other, and the signal level is set to 0. As the result, frequency characteristics of the comb line filter 16 are as shown in FIG. 8, for example. The frequency to generate tremolo is generated at a multiple of fundamental frequency characteristics of the comb line filter coincides with the frequency to generated tremolo by cross-fade. Accordingly, it is possible to decrease the generation of tremolo sound in an interval-controlled reproduced sound.

In the system of FIG. 3, the reading positions are set at 3 positions (3 phases) with different address spacings, and there are fundamental frequencies to generate tremolo for each combination and there are a plenty of them. Therefore, frequency characteristics of the comb line filter may be set in one of them, or frequency characteristics may be adequately changed or a plurality of comb line filters with different frequency characteristics may be furnished. However, it is needless to say that one frequency will suffice if address spacing is equal.

Figure 6:
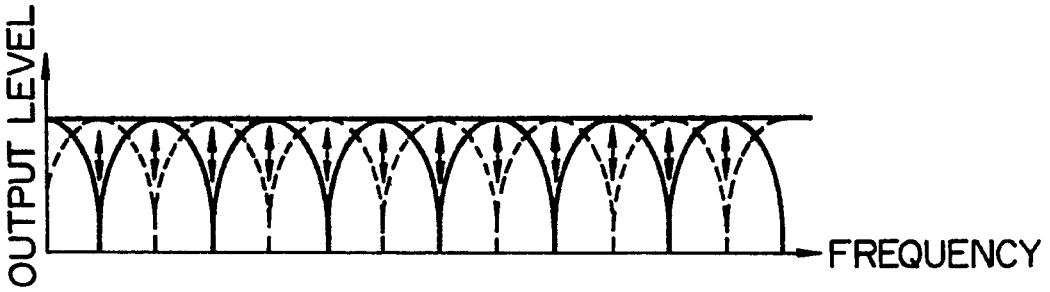
FIG. 6 represents frequency characteristics at cross-fade processing in case the coefficient is changed from −1 to +1.

Further, in the system of FIG. 3, the frequency to generate tremolo changes for each cross-fade processing as shown in FIG. 6. Thus, the frequency characteristics of the comb line filter 16 may be changed by changing the delay time of the delay element 17, or it may be set to one of them. However, if the coefficients $k_a$, $k_b$ and $k_c$ do not take a negative value and change between 0 and +1, there is no need to change frequency characteristics of the comb line filter 16. Or, to two or more fundamental frequencies to generate tremolo, the corresponding comb line filter may be inserted.

In the above embodiment, the input digitized audio signal data are decreased by a predetermined sampling number during the key-up, and the data are increased during the key-down so that the write timing and the read timing can be commonly performed through the interpolation. The invention is not limited to this, and the present invention can also be applied to a system, in which the data can be written in the order of address of the ring buffer by each sampling period when writing and may be read at a speed different from that of writing when reading, or the data can be read partially duplicated or the data to be read are partially jumped and reading may be performed from the subsequent data.

Further, in the above embodiment, description has been given only to the case where the contents of memory is actually transferred as a ring buffer, but the same effect as transfer can be obtained by re-reading the address value by computation.

As described above, it is possible according to the first aspect of the present invention to perform writing and reading at a timing based on a single clock without excess or shortage of the data because the data are interpolated before writing in memory, and a plurality of write memory positions are provided to write while controlling the addresses.

It is possible according to the second aspect of the present invention to disperse the frequency to generate tremolo sound from a specific frequency because time difference between two or more read data are made different by changing address spacings between two or more read memory positions. This reduce level difference of tremolo due to frequency and suppresses generation of tremolo.

Further, according to the third aspect of the present invention, coefficients within a range from a predetermined negative value to a predetermined positive value are set according to address spacing of a write memory position for each of two or more memory positions, and the data read for each of two or more read memory positions are multiplied by the corresponding coefficients, and the resultant data are summed up and are used as output data. Thus, the frequency to generate tremolo changes and the period to generate tremolo at each frequency becomes longer than in a conventional type system, and the feeling tremolo is reduced when listening.

According to the fourth aspect of the present invention, a comb line filter is furnished, and tremolo sound signal component can be eliminated when the frequency with trough at the frequency characteristics of comb line filter coincides with the frequency to generate tremolo due to cross-fade processing. Thus, it is possible to suppress generation of tremolo in the interval-controlled reproduced sound.

What is claimed is:

1. A pitch control system, comprising:

an input means for receiving a digital audio signal containing audio data, said digital audio signal having been sampled at predetermined sampling intervals;

an interpolating means connected to said input means for producing interpolated data pieces from consecutive k data pieces of said digital audio signal where k is a constant, wherein the number of interpolated data pieces produced by said interpolating means is reduced from k to k−j when the pitch of said audio signal is to be raised, and wherein the number of interpolated data pieces produced by said interpolating means is increased from k to k+j when said pitch of said audio signal is to be lowered;

a ring buffer with a predetermined memory size connected to said interpolating means for storing said consecutive interpolated data pieces from said interpolating means;

address specifying means for specifying at least a write address and at least a read address at intervals corresponding to said sampling intervals, wherein an advance of said write address is adjusted to exclude empty space when said number of interpolated data pieces is k−j when the pitch is to be raised, and adjusted so that the written data are not in excess when said number of interpolated data pieces is k+j when the pitch is to be lowered;

writing means for writing at least one of said interpolated data pieces respectively at a write memory position of at least one write address on said ring buffer specified by said address specifying means at said sampling intervals; and reading means for reading at least .one of said interpolated data pieces respectively stored at a memory position of said at least one read address on said ring buffer specified by said address specifying means, at said sampling intervals.

2. A pitch control system as claimed in claim 1, further comprising:

coefficient setting means for setting coefficients according to a distance between a current reading address and a current writing address of said ring buffer for each of a plurality of read memory positions of the ring buffer; and computing means for multiplying the read data from each of the plurality of memory read positions by corresponding one of said coefficients and for summing up the resultant data and using a summed value as an output data;

wherein said address specifying means specifies a plurality of read addresses in a manner that address spacings of said plurality of read addresses are made different from each other.

3. A pitch control system as claimed in claim 1, further comprising:

coefficient setting means for setting coefficients according to a distance between a current reading address and a current writing address of said ring buffer for each of a plurality of read memory positions of the ring buffer; and computing means for multiplying the read data from each of the plurality of memory read positions by corresponding one of said coefficients and for summing up the resultant data and using a summed value as an output data;

wherein said coefficient setting means set each of the coefficients to a value which varies within a range from a predetermined negative value to a predetermined positive value.

4. A pitch control system as claimed in claim 1, further comprising:

coefficient setting means for setting coefficients according to a distance between a current reading address and a current writing address of said ring buffer for each of a plurality of read memory positions of the ring buffer; and computing means for multiplying the read data from each of the plurality of memory read positions by corresponding one of said coefficients and for summing up the resultant data and using a summed value as an output data;

a comb filter based on a delay time equal to a time difference of reading one data piece at a plurality of read memory positions, provided in a signal path of the output signal of said summing means of said computing means, said comb filter including a delay means for delaying the output signal of said summing means; and an adding means for adding said delayed output signal of said summing means to said output signal of said summing means.

* * * * *